United States Patent [19]

Kubota et al.

[11] Patent Number: 4,551,588

[45] Date of Patent: Nov. 5, 1985

[54] TIMER DEVICE

[75] Inventors: Hiromi Kubota, Shizuoka; Toshiyuki Kambe, Mishima, both of Japan

[73] Assignee: Tokyo Electric Co., Ltd., Tokyo, Japan

[21] Appl. No.: 623,388

[22] Filed: Jun. 22, 1984

[30] Foreign Application Priority Data

Jun. 27, 1983 [JP] Japan ..... 58-98934[U]

[51] Int. Cl.[4] ..... H01H 43/00

[52] U.S. Cl. ..... 200/33 R; 200/50 C; 307/141.4

[58] Field of Search ..... 200/33 R, 46, 50 C, 200/308, 38 A, 38 R; 307/141, 141.4, 141.8; 368/236

[56] References Cited

U.S. PATENT DOCUMENTS

| | | | |
|---|---|---|---|
| 2,028,237 | 1/1936 | Och | 200/50 C |
| 4,280,063 | 7/1981 | Yokomori et al. | 307/141.4 |
| 4,463,617 | 8/1984 | Thoma | 200/38 R |

FOREIGN PATENT DOCUMENTS

| | | | |
|---|---|---|---|
| 649086 | 9/1962 | Canada | 200/50 C |
| 58-25539 | 6/1983 | Japan . | |
| 373796 | 1/1964 | Switzerland | 200/46 |

*Primary Examiner*—A. D. Pellinen
*Assistant Examiner*—Morris Ginsburg
*Attorney, Agent, or Firm*—Frishauf, Holtz, Goodman & Woodward

[57] ABSTRACT

A timer device includes a housing for containing a timer circuit and a time unit setting switch to select one of plural time units in the timer circuit. At least two scale plates each have a through-hole for the insertion of a timer circuit knob, engaging projections provided on the edge of each plate, and an engagement releasing recess provided at an edge of each plate. Engaging recesses provided on the housing are engageable with the projections when a selected plate is attached to the housing, and an escaping recess provided on the housing and overlapping the releasing recess, when the plate is attached to the housing, enables access to be attained from outside to the underside of the plate through the recesses. A depression is formed on the plate into which a button of the time unit setting switch is insertable when the button is located at that position which sets in the timer circuit a time unit corresponding to the scale on the plate, and the plate is thus enabled to be attached to the housing. The switch then is also prevented from moving from its initial position. The switch button is blocked from insertion into the depression, so as to prevent the plate from being attached to the housing, when the time unit represented by the scale on the plate does not coincide with the time unit set by the switch in the timer circuit.

2 Claims, 48 Drawing Figures

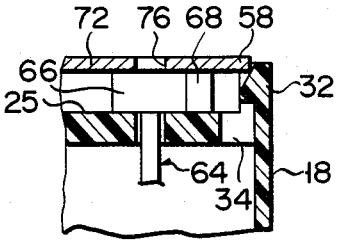
FIG. 18
FIG. 19
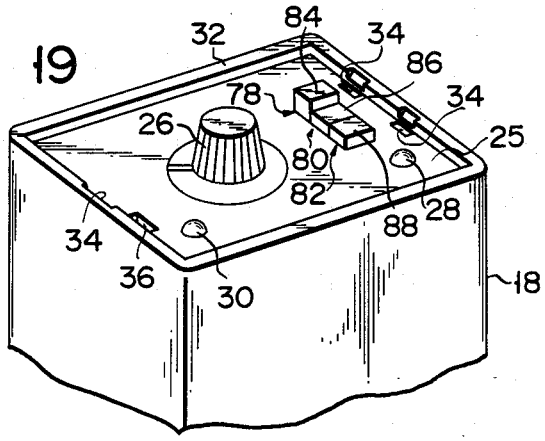
FIG. 20
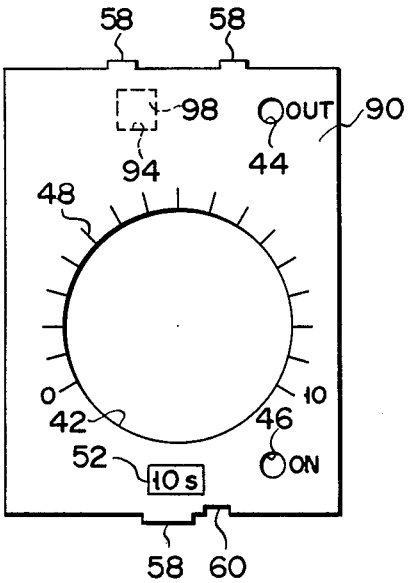
FIG. 21
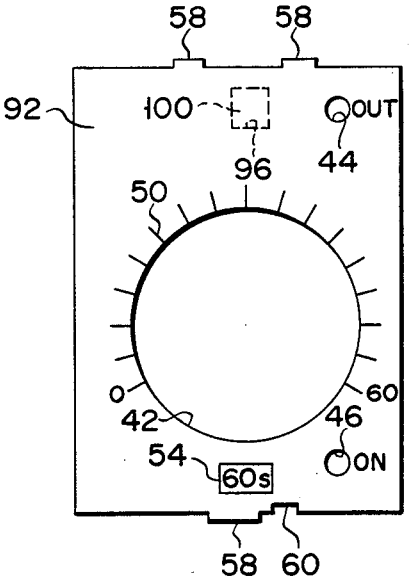

TIMER DEVICE

BACKGROUND OF THE INVENTION

The present invention relates to a timer device capable of setting plural time units by means of switches.

In case of the conventional timer devices of this type, timer circuit means and switches, which move to various positions to set plural time units on the timer circuit means, are housed in a housing, and a time setting knob which is connected to the timer circuit means to render it operative is projected from the outer surface of the housing. A scale plate on which a time scale is displayed is stuck or screwed to that outer surface area of the housing where the time setting knob is projected.

When the time unit is to be changed in the conventional timer device, time unit setting switches housed in the housing must be operated after the back cap of the housing is detached, and while the scale plate is changed. It easily happens, therefore, that a scale plate having a time scale which shows a time unit different from the one set in the timer circuit means by the time unit setting switches is attached to the housing, and the work of correcting this error is troublesome.

If the time unit setting switches are arranged on the outer surface of the housing, the work of setting time units by the switches can be simplified. However, the time unit setting switches arranged on the outer surface of the housing can be easily operated from outside even after a time unit is set. A malfunction is likely to result accordingly.

SUMMARY OF THE INVENTION

The present invention is intended to eliminate the above-mentioned drawbacks. The object of the present invention is therefore to provide a timer device capable of simplifying the time unit changing operation including the work of changing the time unit in the timer circuit by means of the time unit setting switches and the work of replacing the scale plate with a new one, preventing the time unit set in the timer circuit means by the time unit setting switches from not coinciding with the one shown by the time scale on the scale plate which is attached to the housing, and preventing a time unit from being carelessly changed after setting the desired time unit in the timer circuit means.

The object of the present invention can be achieved by a timer device comprising timer circuit means; a time unit setting switch which moves to plural positions to set plural kinds of time units in the timer circuit means; a housing for housing the timer circuit means and the time unit setting switch; a time setting knob connected to the timer circuit means to operate the latter and projected from the housing; at least to scale plates each having a through-hole through which the time setting knob is projected, and each having a time scale corresponding to one of the plural kinds of time units; time scale attaching means for detachably mounting one of the scale plates onto the housing at a predetermined position thereof; and a scale-plate-guiding and time-unit-setting switch-position-holding means arranged at that area of a scale plate selected, said area corresponding to the time unit setting switch which has been located at its predetermined position to set a time unit corresponding to the time scale on the scale plate, when the scale plate is attached to the housing at the predetermined position thereof, and said guiding and holding means enabling the scale plate attaching means to attach the scale plate to the housing at the predetermined position thereof but preventing the time unit setting switch from moving from its position which corresponds to the time unit set in the timer circuit means, in a case where the time unit represented by the time scale on the scale plate coincides with the time unit set in the timer circuit means by the time unit setting switch, and preventing the scale plate from being attached to the housing at the predetermined position thereof in a case where the time unit represented by the time scale on the scale plate does not coincide with the time unit set in the timer circuit means by the time unit setting switch.

In the case of a timer device having such arrangement as described above, it is preferable that the scale plate attaching means includes engaging projections projected from the circumferential edge of the scale plate, an engagement releasing recess provided at the circumferential edge of the scale plate, engaging recesses provided on the housing and being engageable with the engaging projections of the scale plate when the scale plate is attached to the housing at the predetermined position thereof, and an escaping recess provided on the housing and overlapping the engagement releasing recess of the scale plate, when the scale plate is attached to the housing at the predetermined position thereon, to enable access to be attained from outside to the underside surface of the scale plate through the engagement releasing recess.

When constructed as described above, the scale plate attaching means can be made simple in construction and formed integral to the scale plate and the housing, thus making the manufacture of the scale plate attaching means easier and the work of attaching the scale plate easier, too.

In a case where the time unit setting switch is of the sliding type in the timer device of the present invention, it is preferable that the scale-plate-guiding and time-unit-setting switch-position holding means has a depression or hole formed on the scale plate and into which depression or hole is inserted a button of the time unit setting switch, which has been located at its predetermined position to set in the timer circuit means a time unit corresponding to the time scale on a scale plate which is to be located at the predetermined position, when the scale plate is attached to the housing at the predetermined position thereon, thus to prevent the time unit setting switch from moving from its predetermined position.

In a case where the time unit setting switch is of the rotary type in the above-described timer device of the present invention, it is preferable that the scale-plate-guiding and time-unit-setting switch-position holding means has a radial projection radially and outwardly projected from a knob of the time unit setting switch and rotatable together with the knob, and said guiding and holding means also has a depression formed on the scale plate for insertion of the knob and the radial projection of the knob of the time unit setting switch which has been located at its predetermined position to set in the timer circuit means a time unit corresponding to the time scale on the scale plate which is to be attached to the housing at the predetermined position thereof, when the scale plate is attached to the housing at the predetermined position thereon, thus to prevent the knob of the time unit setting switch from rotating from its predetermined position.

In a case where the time unit setting switch is of the push type in the above-described timer device of the present invention, it is preferable that the scale-plate-guiding and time-unit-setting switch-position-holding means has a contact surface formed on the scale plate and which contact surface contacts the operating surface of a button of the time unit setting switch which has been located at its predetermined position to set in the timer circuit means a time unit corresponding to the time scale on a scale plate which is to be arranged at the predetermined position, when the scale plate is attached to the housing at the predetermined position thereon, thus to prevent the time unit setting switch from moving from its predetermined position.

In a case where the time unit setting switch is of the see-saw or rocker type in the above-described timer device of the present invention, it is preferable that the scale-plate-guiding and time-unit-setting switch-position-holding means has a contact surface provided on the scale plate and which contacts the operating surface of a button of the time unit setting switch which has been located at its predetermined position to set in the timer circuit means a time unit corresponding to the time scale on a scale plate which is to be arranged at the predetermined position, when the scale plate is attached to the housing at the predetermined position thereon, thus to prevent the button of the time unit setting switch from moving from its predetermined position.

When the scale-plate-guiding and time-unit-setting switch-position-holding means is variously arranged corresponding to the variously mentioned types of time unit setting switches, it can be made simple in construction and integral to the scale plate, thus allowing its manufacture to be simplified.

Further, in the case where the time unit setting switch is of the push type in the timer device of the present invention, the above-described contact surface of the scale plate can be formed by the underside surface of the scale plate, the bottom surface of a recess formed in the underside surface of the scale plate, or the front end surface of a projection formed on the underside surface of the scale plate.

Furthermore, in the case where the time unit setting switch is of the see-saw type in the timer device of the present invention, the above-described contact surface of the scale plate can be constructed by the underside surface of the scale plate, or front end surface of a projection formed on the underside surface of the scale plate.

BRIEF DESCRIPTION OF THE DRAWINGS

FIG. 18 is a sectional view taken along line XVIII—XVIII in FIG. 17;

FIG. 19 is a perspective view, similar to FIG. 1, showing another variation of the time unit setting switch at that partial area of the outer surface of the housing in the timer device embodied according to the present invention;

FIGS. 20 and 21 are top views showing scale plates which are to be attached to that partial area of the outer surface of the housing shown in FIG. 19 and on which different time scales are formed;

DETAILED DESCRIPTION OF THE PREFERRED EMBODIMENT

Figure 1:
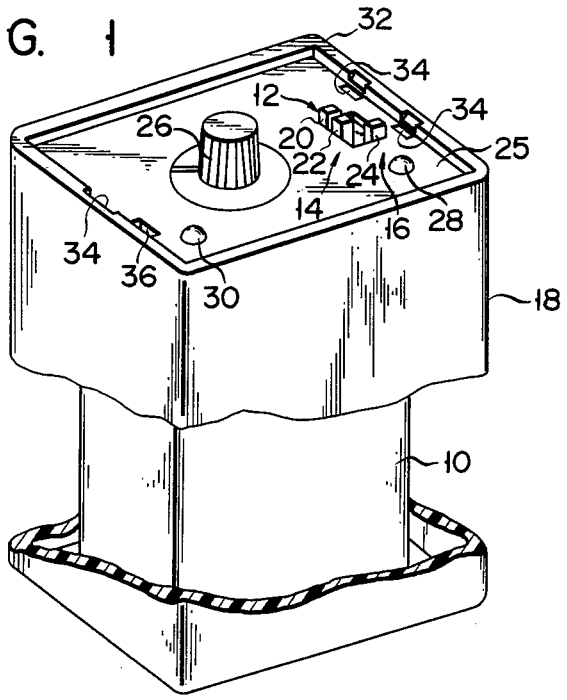
FIG. 1 is a perspective view showing a partial area of the outer surface of a housing in an embodiment of the timer device according to the present invention.

An example of the timer device according to the present invention has a timer circuit means 10 and a housing 18, which houses plural time unit setting switches 12, 14, 16 which move to plural positions to set plural time units in the timer circuit means 10, as shown in FIG. 1. Plural terminal pins (not shown) are projected from the bottom surface of the housing 18 so as to be electrically connected to wiring connectors (not shown).

Since the construction of the timer circuit means 10 is well known to those skilled in the art, and also disclosed by U.S. Pat. No. 4,280,063, for example, it will not be described in detail. When viewed from the top, the housing 18 is not limited to the rectangular shape as shown in the Figures, but may be any optional shape such as a circle or a triangle.

The plural time unit setting switches 12, 14, 16 are slide types, and their knobs or sliders 20, 22, 24 are projected outside from a partial area 25 (the top area) of the outer surface of the housing 18 in the case of this embodiment. A time setting knob 26, connected to the timer circuit means 10 to operate the latter, is also projected from the partial or top area 25 of the outer surface of the housing 18. Operation display lamps 28, 30, which display the operation of the timer circuit means 10, are also arranged at the partial area 25.

Figure 3:
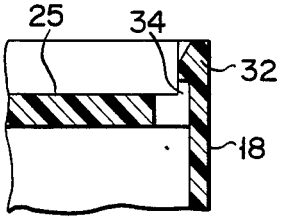
FIG. 3 is a sectional view taken along line III—III in FIG. 2.
Figure 2:
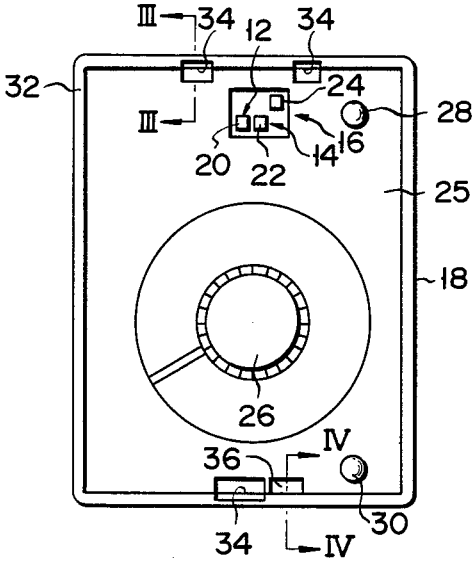
FIG. 2 is a top view showing the partial area of the outer surface of the housing shown in FIG. 1.

A rising portion 32 is continuously formed at the circumferential edge of the partial area 25 of the outer surface of the housing 18, and plural engaging recesses 34 are formed adjacent to those portions where the rising portion crosses the partial area 25, as shown in FIGS. 1 through 3.

Figure 4:
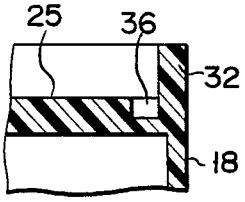
FIG. 4 is a sectional view taken along line IV—IV in FIG. 2.

As shown in FIGS. 2 and 4, an escaping recess 26 is formed along the rising portion 32 at the partial area 25 adjacent to any one of the plural engaging recesses 34.

Each of these engaging and escaping recesses 34, 36 may be communicated with the inside of the housing 18, as shown in FIG. 3, or may not as shown in FIG. 4.

Figure 5:
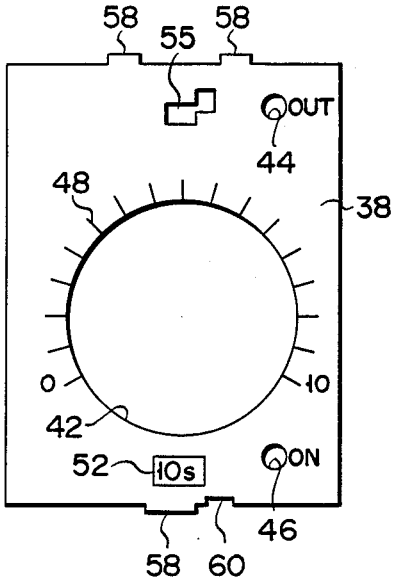
FIGS. 5 and 6 are top views showing scale plates on which different time scales are formed.
Figure 6:
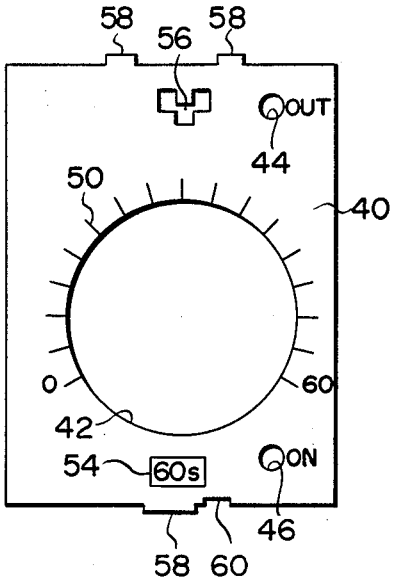

Scale plates may be prepared to meet the number of time units which can be set in the timer circuit by the time unit setting switches 12, 14, 16, and two examples of these scale plates are shown in FIGS. 5 and 6.

Three of the time unit setting switches, 12, 14, 16 which are of the slide type and which slide between two positions, are combined with one another in this example of the timer device. Therefore, a selected one of eight different time units in total can be set in the timer circuit means 10.

Each of the scale plates 38, 40 shown in FIGS. 5 and 6 has a planar shape and an area substantially the same as that of the partial area 25 of the outer surface of the housing 18. Each plate also has a hole 42 through which the time setting knob 26 is projected, and two windows 44, 46 for the two operation display lamps 28, 30. Different time scales 48, 50 are formed around the circumferential edge of the time setting knob projecting holes 42 in the scale plates 38, 40, respectively, and time unit displaying plates 52, 54 which display time units corresponding to the time scales 48, 50 are also attached to the scale plates 38, 40, respectively. Further, openings 55, 56, each corresponding to a relative position of the knobs 20, 22, 24 of the three time unit setting switches 12, 14, 16 which have been located at predetermined positions to set a time unit corresponding to the time scale 48 or 50 shown by the scale plate 38 or 40, are formed in the scale plates 38, 40, respectively. Plural engaging projections 58 are formed integral to the circumferential edge of each of the two scale plates 38, 40, corresponding to the plural engaging recesses 34 formed at the circumferential edge of the partial area 25 of the outer surface of the housing 18. These projections 58 are projected from the circumferential edge of each of the two scale plates 38, 40. An engagement releasing recess 60 is also formed at the circumferential edge of each of the scale plates 38, 40, corresponding to the escaping recess 36 at the circumferential edge of the partial area 25 of the outer surface of the housing 18. The plane area of this engagement releasing recess 60 is set smaller than that of the escaping recess 36 at the partial area 25 of the outer surface of the housing 18.

Figure 7:
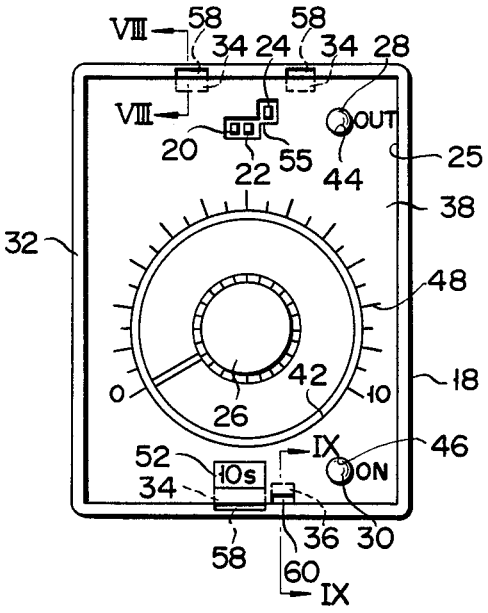
FIG. 7 is a top view showing a state under which the scale plate shown in FIG. 5 is attached to that partial area of the outer surface of the housing shown in FIG. 2.
Figure 8:
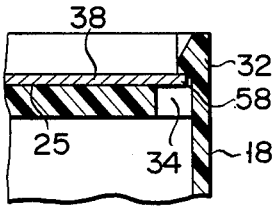
FIG. 8 is a sectional view taken along line VIII—VIII in FIG. 7.
Figure 9:
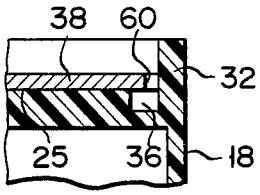
FIG. 9 is a sectional view taken along line IX—IX in FIG. 7.

In a case where the knobs 20, 22, 24 of the three time unit setting switches 12, 14, 16 are located at their predetermined positions, as shown in FIGS. 1 and 2, to set a desired time unit, for example 10 seconds, in the timer circuit means 10 and the scale plate 38 having the time scale 48 thereon which corresponds to the time unit set in the timer circuit means 10 is intended to be attached to the partial area 25 of the outer surface of the housing 18, at first some of the plural engaging projections 58 of the scale plate 38 are engaged with their corresponding engaging recesses 34 of the housing 18. The scale plate 38 is then flexed, and the remaining plural engaging projections 58 of the scale plate 38 are brought into accord with the remaining plural engaging recesses 34 of the housing 18. The force applied to keep the scale plate 38 flexed is then reduced to zero, thereby causing the remaining plural engaging projections 58 of the scale plate 38 to be engaged with the remaining plural engaging recesses 34 of the housing 18. Since the knobs 20, 22, 24 of the three time unit setting switches 12, 14, 16 and the time setting knob 26 projected from the partial area 25 of the outer surface of the housing 18, are inserted as shown in FIG. 7 into the opening 55 and the hole 42, respectively (said opening 55 having been formed in the scale plate 38 to correspond to the knobs 20, 22, 24 of the three time unit setting switches 12, 14, 16 which are located at their predetermined positions so as to set the desired time unit in the timer circuit means 10), the attachment of the scale plate 38 onto the partial area 25 of the outer surface of the housing 18, or such an engagement of all engaging projections 58 of the scale plate 38 with all engaging recesses 34 of the housing 18, as shown in FIG. 8, is not prevented. In addition, access from the outside or top surface, to the backside or bottom surface of the scale plate 38 is made possible through the engagement releasing recess 60 of the scale plate 38 because the engagement releasing recess 60 of the scale plate 38 overlaps the escaping recess 36 of the housing 18, and the plane area of the former recess is set smaller than that of the latter. Further, the time unit already set in the timer circuit means 10 can not be changed unless the scale plate 38 is detached from the housing 18, because the movement of each of the knobs 20, 22, 24 of the three time unit setting switches 12, 14, 16 is prevented by the circumferential edge of the opening 55 of the scale plate 38. Therefore, a careless change of a time unit can be prevented after having set the time unit in the timer circuit means 10.

Figure 10:
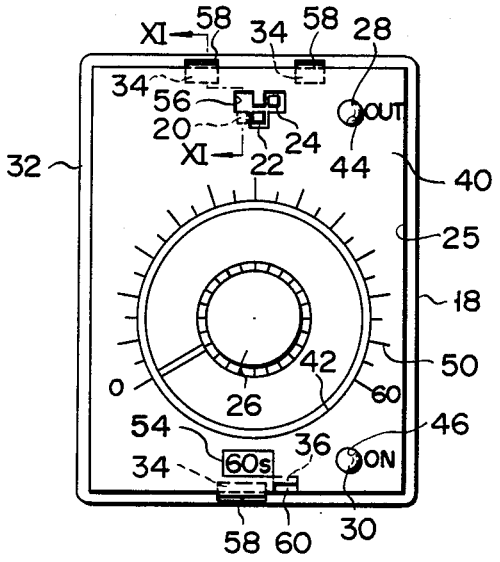
FIG. 10 is a top view showing a state under which the scale plate shown in FIG. 6 is prevented from being attached to that partial area of the outer surface of the housing shown in FIG. 2.
Figure 11:
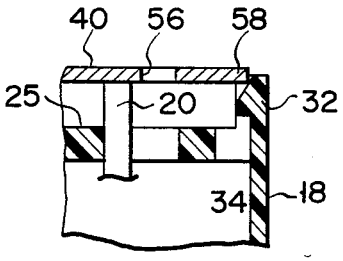
FIG. 11 is a sectional view taken along line XI—XI in FIG. 10.

When the knobs 20, 22, 24 of the three time unit setting switches 12, 14, 16 are located at their predetermined positions, as shown in FIGS. 1 and 2, to set the desired time unit, for example 10 seconds, in the timer circuit means 10, and the scale plate 40 having the time scale 50, i.e., sixty seconds, which does not correspond to the desired time unit set in the timer circuit means 10, is intended to be attached to the partial area 25 of the outer surface of the housing 18, some of the three time unit setting switches, which are located at their predetermined positions to set the desired time unit in the timer circuit means 10, abut the underside surface of the scale plate 40, as shown in FIGS. 10 and 11. Therefore, the attachment of the scale plate 40 onto the partial area 25 of the outer surface of the housing 18, or engagement of at least one engaging projection 58 of the scale plate 40 with the corresponding at least one engaging recess 34 of the housing 18, is prevented. As a result, the scale plate 40 having the time scale 50 thereon, which corresponds to a time unit different from the time unit already set in the timer circuit means 10 by the time unit setting switches 12, 14, 16, can never be attached to the partial area 25 of the outer surface of the housing 18.

Figure 12:
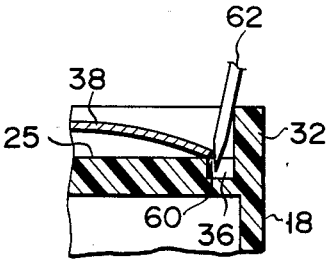
FIG. 12 is a sectional view, similar to FIG. 9, showing a state under which the scale plate shown in FIG. 7 is detached from the housing.

When another time unit is to be set in the timer circuit means 10 where a certain time unit has been already set as described above, a rod or spatula, such as the foremost end of a screwdriver 62, is inserted into the escaping recess 36 of the housing 18 through the engagement releasing recess 60 of the scale plate 38, as shown in FIG. 12, to force the circumferential edge of the scale plate 38 to separate from the rising portion 32 of the housing 18 and to make the scale plate 38 itself flexed, so that the engaging projection 58 adjacent to the engagement releasing recess 60 can be disengaged from its corresponding engaging recess 34 of the housing 18, and the remaining engaging projections 58 can be thus disengaged from their corresponding engaging recesses 34 of the housing 18. When the scale plate 38 is thus detached from the partial area 25 of the outer surface of the housing 18, any desired time unit can be then set in the timer circuit means 10 by operating the time unit setting switches 12, 14 and 16, respectively.

As apparent from the above, the knobs 20, 22, 24 of the time unit setting switches 12, 14 16 are projected outside from the partial area 25 of the outer surface of the housing 18, similarly to the time setting knob 26, thereby enabling the time unit set in the timer circuit means to be easily changed by the time unit setting switches 12, 14, 16. In addition, the scale plate 38 or 40 can be replaced by a new one by releasing or engaging the plural engaging projections 58 of the scale plate 38 or 40 from or with their corresponding plural engaging recesses 34 of the housing 18, thereby enabling the replacement of the scale plate to be easily attained.

It should be understood that the above-described embodiment is intended to explain the present invention and does not limit the present invention, and that various modifications and improvements can be made without departing from the spirit and scope of the present invention.

The number of the time unit setting switches, for example, may be one, or two, or more than three.

The openings 55, 56 of the scale plates 38, 40 have been shown as through-holes in the case of this embodiment, but they may be blind holes formed in the undersides of the scale plates 38, 40.

Figure 13:
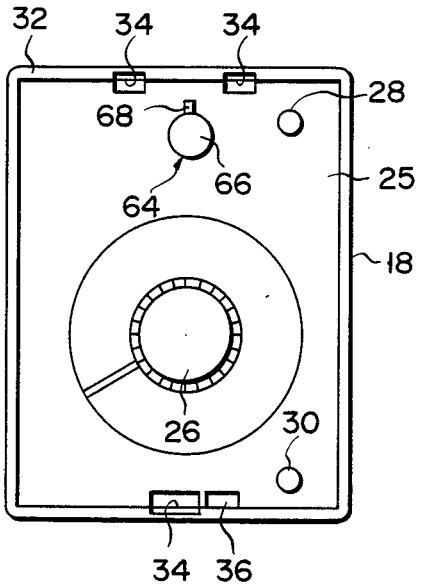
FIG. 13 is a top view, similar to FIG. 2, showing a variation of the time unit setting switch at that partial area of the outer surface of the housing in the timer device embodied according to the present invention.
Figure 14:
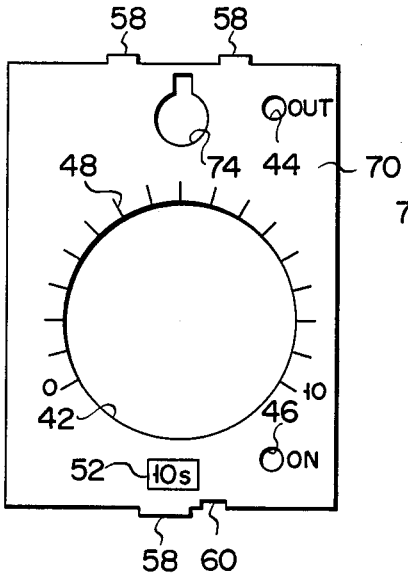
FIGS. 14 and 15 are top views showing scale plates which are to be attached to that partial area of the outer surface of the housing shown in FIG. 13 and on which different time scales are formed.
Figure 15:
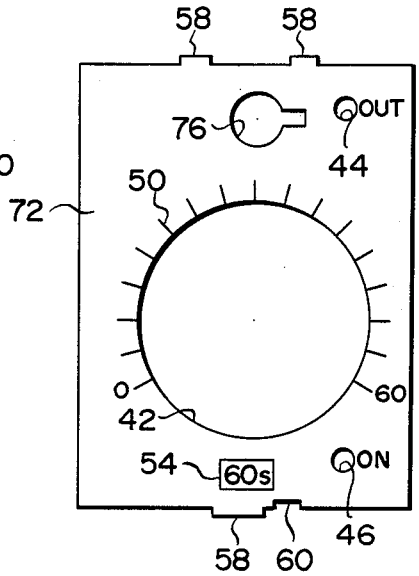

The time unit setting switch may be formed as a rotary switch 64, as shown in FIG. 13. In this case, however, a knob 66 of the rotary switch 64 which serves as the time unit setting switch must be projected from the partial area 25 of the outer surface of the housing 18, similarly to the time setting knob 26, and a radial projection 68 which rotates together with the knob 66 must be projected radially and outwardly from the knob 66. Further, scale plates may be prepared to meet the number of time units which can be set in the timer circuit means 10 by the rotary switch 64. Two examples of these scale plates are shown in FIGS. 14 and 15, and each of these two scale plates 70, 72, similar to the two scale plates 38, 40 shown in FIGS. 5 and 6, has substantially the same plane planar shape and area as those of the partial area 25 of the outer surface of the housing 18. In addition, an opening 74 or 76 is formed in the scale plate 70 or 72 to receive the radial projection 68 and the knob 66 of the rotary switch 64 which serves as the time unit setting switch, and which has been located at its predetermined position to set in the timer circuit means 10 a time unit corresponding to the time scale 48 or 50 on the scale plate 70 or 72.

Figure 16:
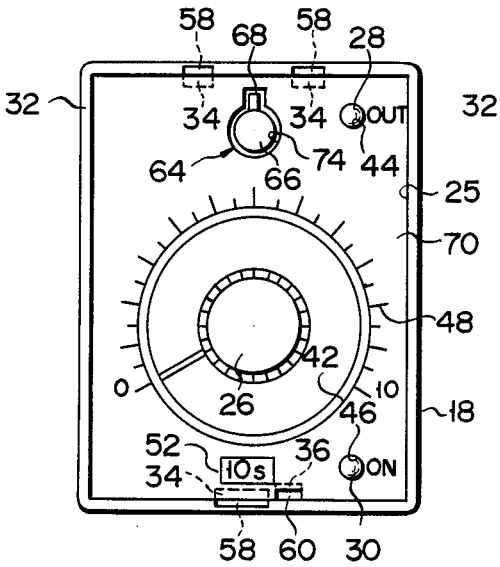
FIG. 16 is a top view showing a state under which the scale plate shown in FIG. 14 is attached to that partial area of the outer surface of the housing shown in FIG. 13.

In a case where the scale plate 70 having the time scale 48 thereon which corresponds to the desired time unit, for example 10 seconds, set in the timer circuit means 10 by the rotary switch 64 is attached to the partial area 25 of the outer surface of the housing 18, the knob 66 and the radial projection 68 of the rotary switch 64 are inserted into the opening 74 of the scale plate 70, as shown in FIG. 16, thereby enabling the scale plate 70 to be attached to the partial area 25 of the outer surface of the housing 18, that is, all engaging projections 58 of the scale plate 70 engaged with all engaging recesses 34 of the housing 18. The rotation of the knob 66 of the rotary switch 64 is prevented by the engagement between the opening 74 of the scale plate 70 and the radial projection 68 in the state when the scale plate 70 is attached to the partial area 25 of the outer surface of the housing 18, so that the time unit already set in the timer circuit means 10 cannot be changed unless the scale plate 70 is detached from the housing 18.

Figure 17:
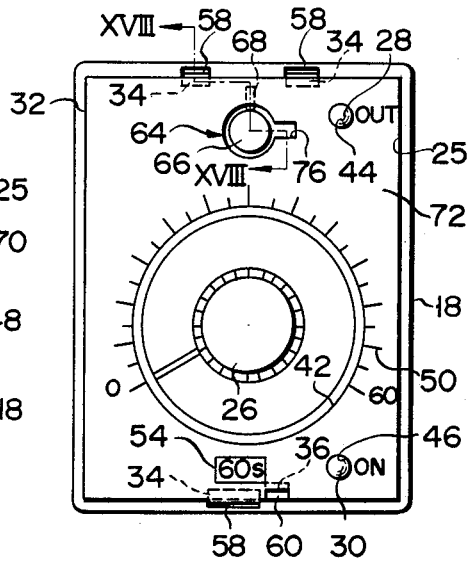
FIG. 17 is a top view showing a state under which the scale plate shown in FIG. 15 is prevented from being attached to that partial area of the outer surface of the housing shown in FIG. 13.

In a case where the scale plate 72 has the time scale 50 thereon which does not correspond to the desired time unit, for example 10 seconds, set in the timer circuit means 10 by the rotary switch 64 is to be attached to the partial area 25 of the outer surface of the housing 18, the radial projection 68 of the knob 66 of the rotary switch 64 abuts against the underside surface of the scale plate 72, as shown in FIGS. 17 and 18. The attachment of the scale plate 72 onto the partial area 25 of the outer surface of the housing 18, that is, engagement of at least one engaging plural projection 58 of the scale plate 72 with corresponding at least one engaging plural recess 34 of the housing 18, can be thus prevented.

The time unit setting switches may be push types 78, 80, 82, as shown in FIG. 19. In this case, buttons 84, 86, 88 of the push switches 78, 80, 82 which serve as the time unit setting switches must be projected from the partial area 25 of the outer surface of the housing 18, similar to the time setting knob 26, and the scale plates may be prepared to meet the number of time units which can be set in the timer circuit means 10 by the push switches 78, 80, 82. Two examples of these scales plates are shown in FIGS. 20 and 21, an each of these two scale plates 90, 92, similar to the two scale plates 38, 40 shown in FIGS. 5 and 6, has substantially the same planar shape and area as those of the partial area 25 of the outer surface of the housing 18. In addition, each of the scale plates 90, 92 must have a contact surface which is brought into contact with the pushed or operating surfaces of the buttons 84, 86, 88 of the three push switches 78, 80, 82 which have been located at their predetermined positions to set in the timer circuit means 10 at a time unit corresponding to the time scale 48 or 50 on the scale plate 90 or 92, when the scale plate 90 or 92 having the time scale thereon which corresponds to the time unit set in the timer circuit means 10 is attached to the partial area 25 of the outer surface of the housing 18, to thereby prevent the buttons 84, 86, 88 of the push switches 78, 80, 82 from moving from their predetermined positions.

As shown in FIGS. 20 and 21, this contact surface can be formed by setting the distance between the underside surface 102 or 104 and a bottom surface 98 or 100 of a recess 94 or 96 of each of the scale plates 90, 92 and the partial area 25 of the outer surface of the housing 18, when all of the plural engaging projections 58 of each of the scale plates 90, 92 are engaged with all of the plural engaging recesses 34 of the housing 18, according to the heights of the pushed surfaces of the buttons 84, 86, 88 of the three push switches 78, 80, 82 which have been located at their predetermined positions to set in the timer circuit means 10 a time unit corresponding to the time scale on each of the scale plates 90, 92.

Figure 22:
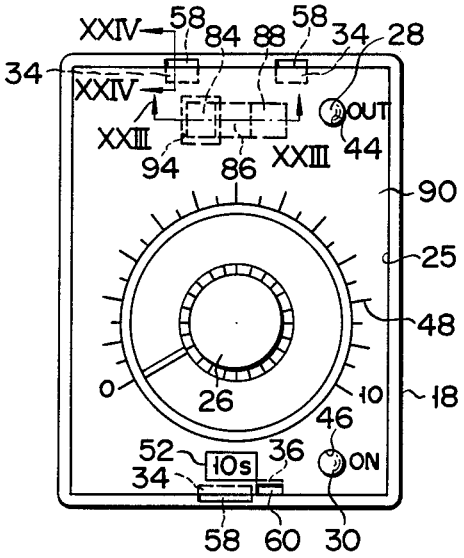
FIG. 22 is a top view showing a state under which the scale plate shown in FIG. 20 is attached to that partial area of the outer surface of the housing shown in FIG. 19.
Figure 23:
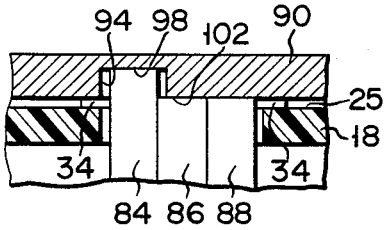
FIG. 23 is a sectional view taken along line XXIII—XXIII in FIG. 22.
Figure 24:
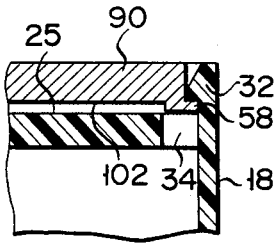
FIG. 24 is a sectional view taken along line XXIV—XXIV in FIG. 22.

In a case where the scale plate 90 having the time scale 48 thereon which corresponds to a desired time unit, for example 10 seconds, set in the timer circuit means 10 by the three push switches 78, 80, 82 is intended to be attached to the partial area 25 of the outer surface of the housing 18, all of the pushed surfaces of the buttons 84, 86, 88 of the push switches 78, 80, 82 which have been located at their predetermined positions are contacted with the underside surface 102 of the scale plate 90 and of the bottom surface 98 of the recess 94 formed on the underside surface 102, those of which serve as the contact surface, as shown in FIG. 23, without creating such clearance as allows the buttons 84, 86, 88 to move significantly. Accordingly, the attachment of the scale plate 90 onto the partial area 25 of the outer surface of the housing 18, or such engagement of all engaging projections 58 of the scale plate 90 with all engaging recesses 34 of the housing 18 as shown in FIGS. 22 and 24, cannot be prevented. Since the buttons 84, 86, 88 of the three push switches 78, 80, 82 which serve as the time unit setting switches cannot be touched from outside when the scale plate 90 is attached to the partial area 25 of the housing 18, the time unit which has been already set in the timer circuit means 10 cannot be changed unless the scale plate 90 is detached from the housing 18.

Figure 25:
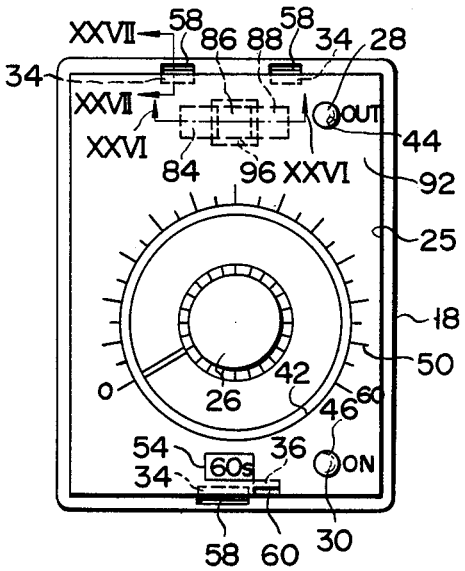
FIG. 25 is a top view showing a state under which the scale plate shown in FIG. 21 is prevented from being attached to that partial area of the outer surface of the housing shown in FIG. 19.
Figure 26:
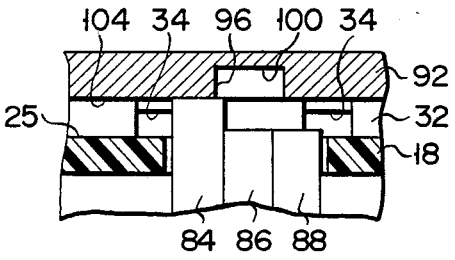
FIG. 26 is a sectional view taken along line XXVI—XXVI in FIG. 25.
Figure 27:
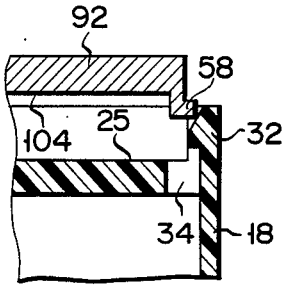
FIG. 27 is a sectional view taken along line XXVII—XXVII in FIG. 25.

In a case where the scale plate 92 having the time scale 50 thereon which does not correspond to the desired time unit, for example 10 seconds, set in the timer circuit means 10 by the three push switches 78, 80, 82 is to be attached to the partial area 25 of the outer surface of the housing 18, at least one of the pushed surfaces of the buttons 84, 86, 88 of the push switches 78, 80, 82 which have been located at their predetermined positions, is not contacted with either the underside surface 104 of the scale plate 92 or the bottom surface 100 of the recess 96 formed on the underside surface 104. Those members which provide contact surface, as shown in FIG. 26, separate some the buttons 84, 86, 88 of the push switches 78, 80, 82 from the underside surface 104 and the bottom surface 100 of the recess 96 to create such clearance between them as allows the buttons 84, 86, 88 to move significantly. Since the scale plate 92 cannot be attached onto the partial area 25 of the outer surface of the housing 18 to engage all engaging projections 58 of the scale plate 92 with all engaging recesses 34 of the housing 18, therefore, the attachment of the scale plate 92 onto the partial area 25 of the outer surface of the housing 18, or engagement of at least one engaging projection 58 of the scale plate 92 with the corresponding at least one engaging recess 34 of the housing 18, can be prevented as shown in FIGS. 25 and 27.

Figure 28:
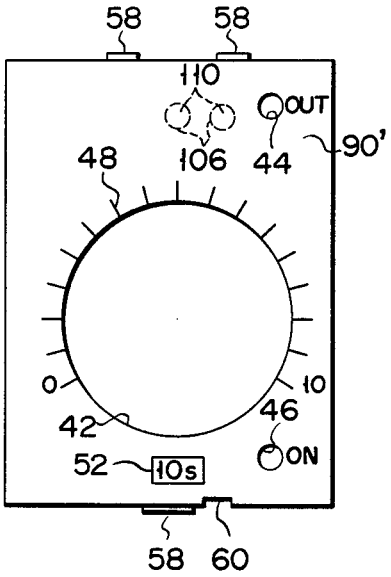
FIGS. 28 and 29 are top views showing scale plates, which have different time scales, to be attached to that partial area of the outer surface of the housing shown in FIG. 19, and which are different from those shown in FIGS. 20 and 21.
Figure 29:
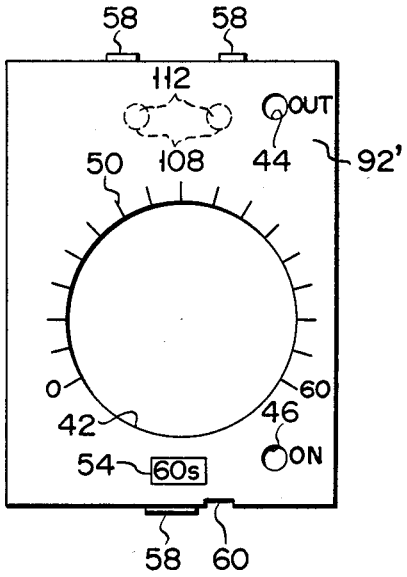

When the time unit setting switches are the push types 78, 80, 82, the above-described contact surface can be formed, as shown in FIGS. 28 and 29, by setting the distance between the underside surface 114 or 116 and a front end surface 110 or 112 of a projection 106 or 108 formed on the underside surface 114 or 116 of each of scale plates 90', 92', and the partial area 25 of the housing 18, when all engaging projections 58 of each of the scale plates 90', 92' are engaged with all engaging recesses 34 of the housing 18, according to the heights of the pushed surfaces of the buttons 84, 86, 88 of the three push switches 78, 80, 82 which have been located at their predetermined positions to set in the timer circuit means 10 a time unit corresponding to the time scale on each of the scale plates 90', 92'.

Figure 30:
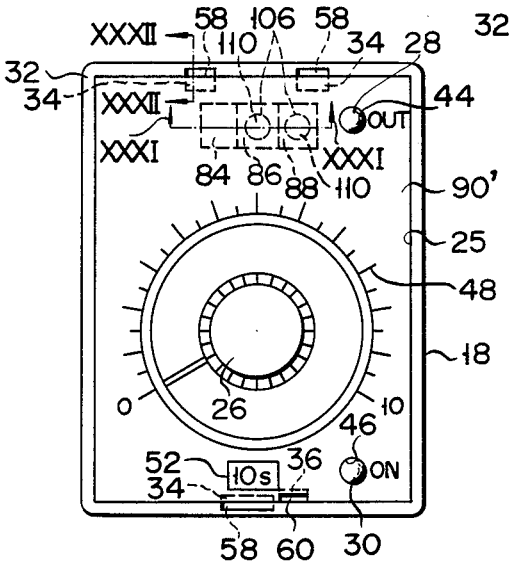
FIG. 30 is a top view showing a state under which the scale plate shown in FIG. 28 is attached to that partial area of the outer surface of the housing shown in FIG. 19.
Figure 31:
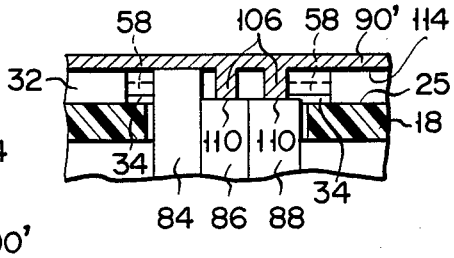
FIG. 31 is a sectional view taken along line XXXI—XXXI in FIG. 30.
Figure 32:
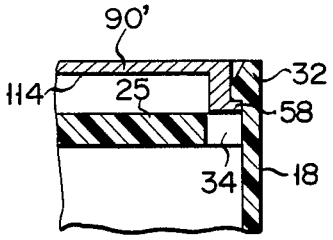
FIG. 32 is a sectional view taken along line XXXII—XXXII in FIG. 30.

In a case where the scale plate 90' having the time scale 48 thereon which corresponds to the desired time unit, for example 10 seconds, set in the timer circuit means 10 by the three push switches 78, 80, 82 which serve as the time unit setting switches, is to be attached to the partial area 25 of the outer surface of the housing 18, all of the pushed surfaces of the buttons 84, 86, 88 of the push switches 78, 80, 82 which have been located at their predetermined positions are brought into contact with the underside surface 114 of the scale plate 90' and the front end surfaces 110 of all the projections 106 formed on the underside surface 114 which serve as a contact surface as shown in FIG. 31, without creating such clearance as allows the buttons 84, 86, 88 to move significantly. Accordingly, the attachment of the scale plate 90' onto the partial area 25 of the outer surface of the housing 18, or such engagement of all engaging projections 58 of the scale plate 90' with all engaging recesses 34 of the housing 18 as shown in FIGS. 30 and 32, cannot be prevented. Since the buttons 84, 86, 88 of the three push switches 78, 80, 82 which serve as the time unit setting switches cannot be touched from outside when the scale plate 90' is attached to the partial area 25 of the outer surface of the housing 18, the time unit which has been already set in the timer circuit means 10 cannot be changed unless the scale plate 90' is detached from the housing 18.

Figure 33:
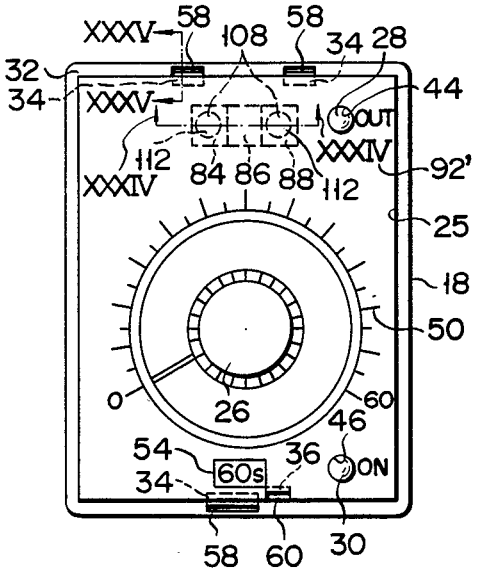
FIG. 33 is a top view showing a state under which the scale plate shown in FIG. 29 is prevented from being attached to that partial area of the outer surface of the housing shown in FIG. 19.
Figure 34:
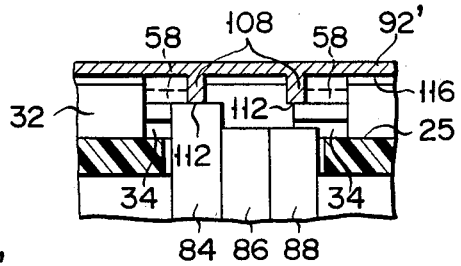
FIG. 34 is a sectional view taken along line XXXIV—XXXIV in FIG. 33.
Figure 35:
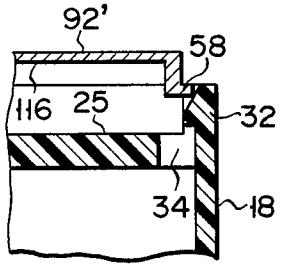
FIG. 35 is a sectional view taken along line XXXV—XXXV in FIG. 33.

In a case where the scale plate 92' having the time scale 50 thereon which does not correspond to the desired time unit, for example 10 seconds, set in the timer circuit means 10 by the three push switches 78, 80, 82 is to be attached to the partial area 25 of the outer surface of the housing 18, at least one of the pushed surfaces of the buttons 84, 86, 88 of the push switches 78, 80, 82 which have been located at their predetermined positions, is not contacted with either the underside surface 116 of the scale plate 92' or any of the front end surfaces 112 of the projections 108 formed on the underside surface 116. Those members which provide the contact surface, as as shown in FIG. 34, separate some of the buttons 84, 86, 88 of the push switches 78, 80, 82 from the underside surface 116 and the front end surfaces 112 of the projections 108 to create between them such clearance as allows the buttons 84, 86, 88 to move significantly. Therefore, the scale plate 92' cannot be attached to the partial area 25 of the outer surface of the housing 18 to engage all engaging projections 58 of the scale plate 92' with all engaging recesses 34 of the housing 18. The attachment of the scale plate 92' to the partial area 25 of the outer surface of the housing 18, or engagement of at least one engaging projection 58 of the scale plate 92' with the corresponding at least one engaging recess 34 of the housing 18, can be thus prevented as shown in FIGS. 33 and 35.

Figure 36:
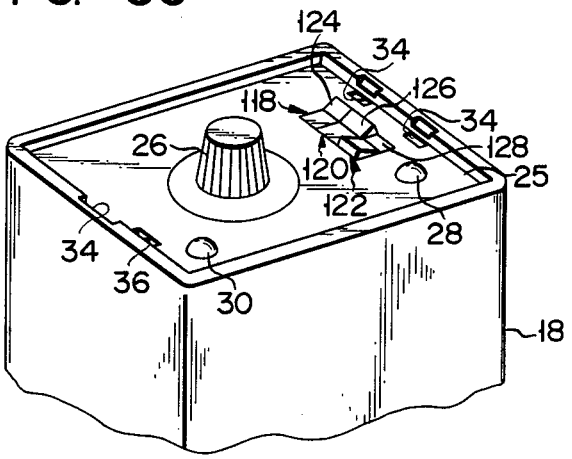
FIG. 36 is a perspective view, similar to FIG. 1, showing further variation of the time unit setting switch at that partial area of the outer surface of the housing in the timer device embodied according to the present invention.
Figure 37:
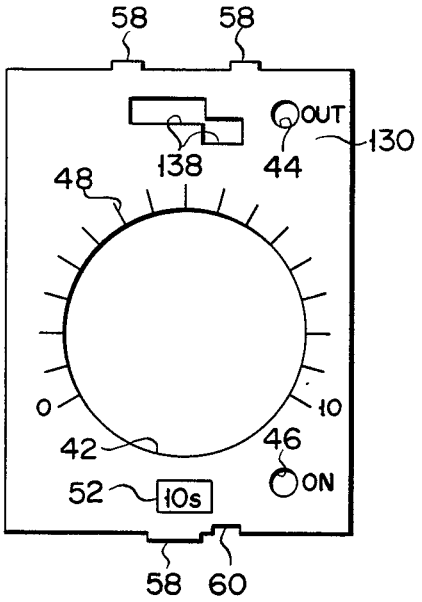
FIGS. 37 and 38 are top views showing scale plates which are to be attached to that partial area of the outer surface of the housing shown in FIG. 36 and on which different time scales are formed.
Figure 38:
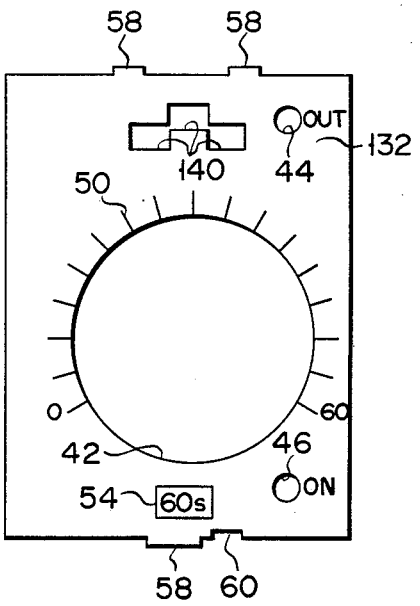

The time unit setting switches may be see-saw or rocker types 118, 120, 122, as shown in FIG. 36. In this case, buttons 124, 126, 128 of the see-saw switches 118, 120, 122 which serve as the time unit setting switches must be projected from the partial area 25 of the outer surface of the housing 18, similar to the time setting knob 26, and the scale plates may be prepared to meet the number of time units which can be set in the timer circuit means 10 by the see-saw switches 118, 120, 122. Two examples of these scale plates are shown in FIGS. 37 and 38, and each of these two scale plates 130, 132, similar to the two scale plates 38, 40 shown in FIGS. 5 and 6, has substantially the same plan or shape and area as those of the partial area 25 of the outer surface of the housing 18. In addition, each of the scale plates 130, 132 must have a contact surface which is brought into contact with the pushed or operating surfaces of the buttons 124, 126, 128 of the three see-saw switches 118, 120, 122 which have been located at their predetermined positions to set in the timer circuit means 10 a time unit corresponding to the time scale 48 or 50 on the scale plate 130 or 132, when the scale plate 130 or 132 having the time scale thereon which corresponds to the time unit set in the timer circuit means 10 is attached to the partial area 25 of the outer surface of the housing 18, thus to prevent the buttons 124, 126, 128 of the see-saw switches 118, 120, 122 from moving from their predetermined positions.

As shown in FIGS. 37 and 38, the contact surface can be constructed by forming opening 138 or 140, corresponding to the projected portion 133 (see FIGS. 40 and 41) of each of the pushed surfaces of the buttons 124, 126, 128 of the three see-saw switches 118, 120, 122 which have been located at their predetermined positions to set in the timer circuit means 10 a time unit corresponding to the time scale on each of the scale plates 130, 132, and by setting such a distance between the underside surface 134 or 136 of each of the scale plates 130, 132 and the partial area 25 of the outer surface of the housing 18 that the underside surface 134 or 136 of the scale plate 130 or 132 contacts the flat portion 141 (see FIGS. 40 and 41) of each of the pushed surfaces of the buttons 124, 126, 128 in order to prevent the buttons 124, 126, 128 from rocking significantly from their predetermined positions, when all of the plural engaging projections 58 of each of the scale plates 130, 132 are engaged with all of the plural engaging recesses 34 of the housing 18.

Figure 39:
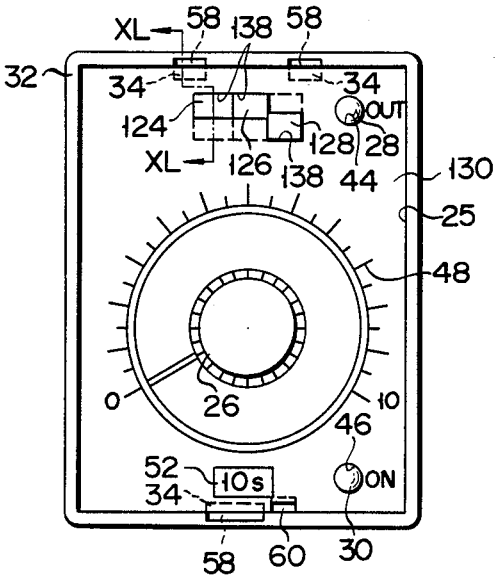
FIG. 39 is a top view showing a state under which the scale plate shown in FIG. 37 is attached to that partial area of the outer surface of the housing shown in FIG. 36.
Figure 40:
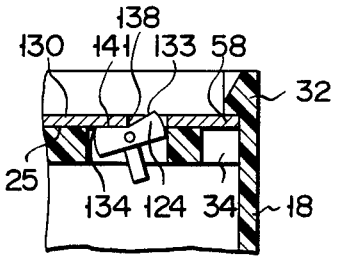
FIG. 40 is a sectional view taken along line XL—XL in FIG. 39.

In a case where the scale plate 130 having the time scale 48 thereon which corresponds to a desired time unit, for example 10 seconds, set in the timer circuit means 10 by the three see-saw switches 118, 120, 122 is intended to be attached to the partial area 25 of the outer surface of the housing 18, all of the projected portion 133 of the pushed surfaces of the buttons 124, 126, 128 of the see-saw switches 118, 120, 122 which have been located at their predetermined positions are inserted into the opening 138 of the scale plate 130, as shown in FIG. 40. All of the flat portions 141 of the pushed surfaces of the buttons 124, 126, 128 are then contacted with the underside surface 134 of the scale plate 130, as shown in FIG. 40, without creating such clearance as allows the buttons 124, 126, 128 to rock significantly so that the attachment of the scale plate 130 onto the partial area 25 of the outer surface of the housing 18, or such engagement of all engaging projections 58 of the scale plate 130 with all engaging recesses 34 of the housing 18 as shown in FIGS. 39 and 40, cannot be prevented. The projected portions 133 of the buttons 124, 126, 128 of the three see-saw switches 118, 120, 122 which serve as the time unit setting switches can be touched from outside when the scale plate 130 is attached to the partial area 25 of the housing 18. However, since the underside surface 134 of the scale plate 130 is contacted with all of the flat portions 141 of the buttons 124, 126, 128 so as to prevent the buttons 124, 126, 128 from moving from their predetermined positions, the time unit which has been already set in the timer circuit means 10 cannot be changed unless the scale plate 130 is detached from the housing 18.

Figure 41:
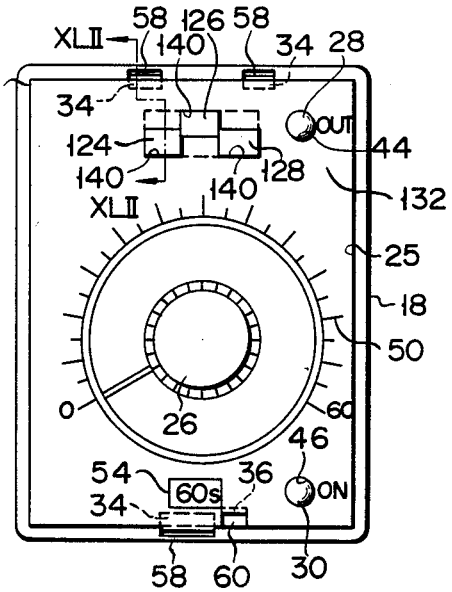
FIG. 41 is a top view showing a state under which the scale plate shown in FIG. 38 is prevented from being attached to that partial area of the outer surface of the housing shown in FIG. 36.
Figure 42:
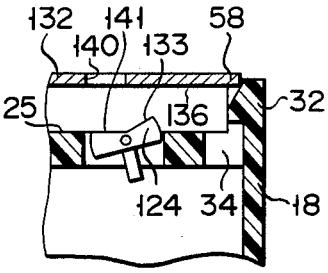
FIG. 42 is a sectional view taken along line XLII—XLII in FIG. 41.

In a case where the scale plate 132 having the time scale 50 thereon which does not correspond to the desired time unit, for example 10 seconds, set in the timer circuit means 10 by the three see-saw switches 118, 120, 122 is to be attached to the partial area 25 of the outer surface of the housing 18, at least one of the projected portions 133 of the pushed surfaces of the buttons 124, 126, 128 of the see-saw switches 118, 120, 122 which have been located at their predetermined positions, is not inserted into the opening 140 but contacts the underside surface 136 of the scale plate 132, thus separating all of the flat portions 141 of the pushed surfaces of the buttons 124, 126, 128 of the see-saw switches 118, 120, 122 from the underside surface 136 to create such clearance between them as allows the buttons 124, 126, 128 to rock significantly. Since the scale plate 132 cannot be attached onto the partial area 25 of the outer surface of the housing 18 to engage all engaging projections 58 of the scale plate 132 with all engaging recesses 34 of the housing 18, therefore, the attachment of the scale plate 132 onto the partial area 25 of the outer surface of the housing 18, or engagement of at least one engaging projection 58 of the scale plate 132 with the corresponding at least one engaging recess 34 of the housing 18, can be prevented as shown in FIGS. 41 and 42.

In the modification described above, the openings 138, 140 for receiving the projected portions 133 of the pushed surfaces of the buttons 124, 126, 128 of the see-saw switches 118, 120, 122 are through holes, but the openings 138, 140, may be blind holes formed on the underside surfaces 134, 136 of the scale plates 130, 132.

Figure 43:
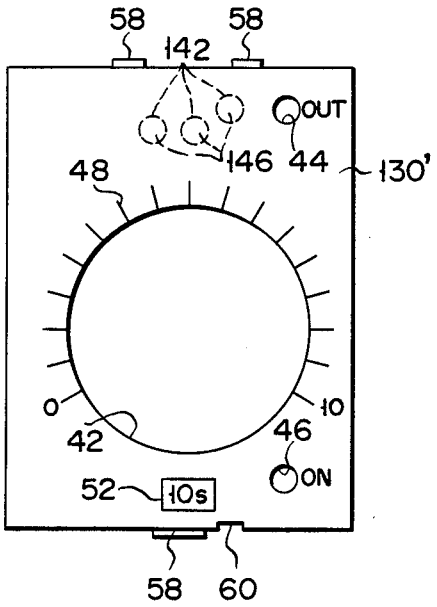
FIGS. 43 and 44 are top views showing scale plates, which have different time scales, to be attached to that partial area of the outer surface of the housing shown in FIG. 36, and which are different from those shown in FIGS. 37 and 38.
Figure 44:
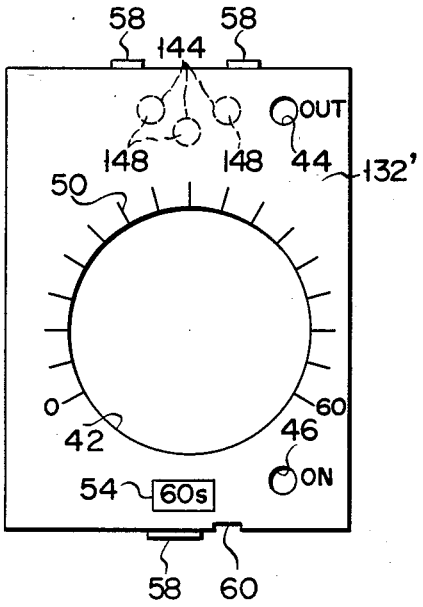

When the time unit setting switches are the see-saw types 118, 120, 122, the above-described contact surface can be formed, as shown in FIGS. 43 and 44, but setting the distance between the underside surface 134 or 136 and a front end surface 146 or 148 of a projection 142 or 144 formed on the underside surface 134 or 136 of each of scale plates 130', 132', and the partial area 25 of the housing 18, when all engaging projections 58 of each of the scale plates 130', 132' are engaged with all engaging recesses 34 of the housing 18, so as to contact the front end surface 146 or 148 formed on the underside surface 134 or 136 of the scale plate 130' or 132' with the flat portion 141 of the pushed surfaces of the buttons 124, 126, 128 of the three see-saw switches 118, 120, 122 which have been located at their predetermined positions to set in the timer circuit means 10 a time unit corresponding to the time scale on each of the scale plates 130', 132', without creating such clearance as allows the buttons 124, 126, 128 to rock significantly.

Figure 45:
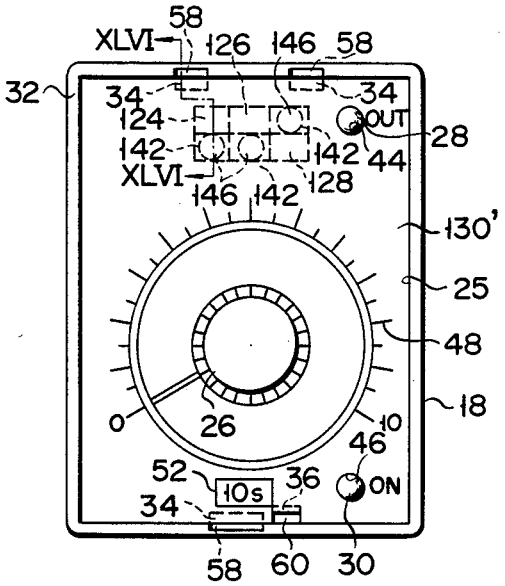
FIG. 45 is a top view showing a state under which the scale plate shown in FIG. 43 is attached to that partial area of the outer surface of the housing shown in FIG. 36.
Figure 46:
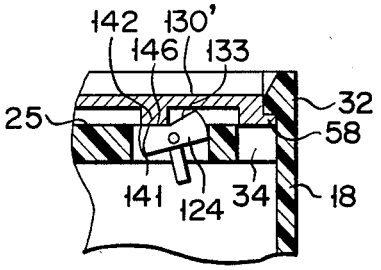
FIG. 46 is a sectional view taken along line XLVI—XLVI in FIG. 45.

In a case where the scale plate 130' having the time scale 48 thereon which corresponds to the desired time unit, for example 10 seconds, set in the timer circuit means 10 by the three see-saw switches 118, 120, 122 which serve as the time unit setting switches is to be attached to the partial area 25 of the outer surface of the housing 18, all of the flat portions 141 of the pushed surfaces of the buttons 124, 126, 128 of the see-saw switches 118, 120, 122 which have been located at their predetermined positions are brought into contact with the front end surfaces 146 of the projections 142 formed on the underside surface 134 of the scale plate 130', as shown in FIG. 46, without creating such clearance as allows the buttons 124, 126, 128 to rock significantly. Accordingly, the attachment of the scale plate 130' onto the partial area 25 of the outer surface of the housing 18, or such engagement of all engaging projections 58 of the scale plate 130' with all engaging recesses 34 of the housing 18 as shown in FIGS. 45 and 46 cannot be prevented. Since the pushed surfaces of the buttons 124, 126, 128 of the three see-saw switches 118, 120, 122 which serve as the time unit setting switches cannot be touched from outside when the scale plate 130' is attached to the partial area 25 of the outer surface of the housing 18, the time unit which has been already set in the timer circuit means 10 cannot be changed unless the scale plate 130' is detached from the housing 18.

Figure 47:
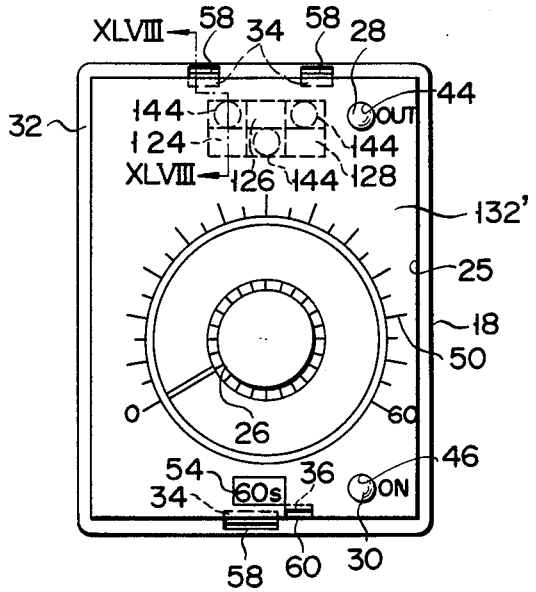
FIG. 47 is a top view showing a state under which the scale plate shown in FIG. 44 is prevented from being attached to that partial area of the outer surface of the housing shown in FIG. 36.
Figure 48:
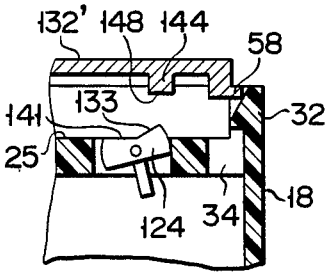
FIG. 48 is a sectional view taken along line XLVIII—XLVIII in FIG. 47.

In a case where the scale plate 132' having the time scale 50 thereon which does not correspond to the desired time unit, for example 10 seconds, set in the timer circuit means 10 by the three see-saw switches 118, 120, 122 is to be attached to the partial area 25 of the outer surface of the housing 18, at least one of the projected portions 133, not the flat portions 141, of the pushed surfaces of the buttons 124, 126, 128 of the see-saw switches 118, 120, 122 which have been located at their predetermined positions faces at least one of the front end surfaces 148 of the projections 144 of the scale plate 132', as shown in FIG. 48, thus separating all of the flat portions 141 of the pushed surfaces of the buttons 124, 126, 128 of the see-saw switches 118, 120, 122 from other front end surfaces 148 of the projections 144 of the scale plate 132' to create between them such clearance as allows the buttons 124, 126, 128 to rock significantly. Therefore, the scale plate 132' cannot be attached to the partial area 25 of the outer surface of the housing 18 to engage all engaging projections 58 of the scale plate 132' with all engaging recesses 34 of the housing 18. The attachment of the scale plate 132' to the partial area 25 of the outer surface of the housing 18, or engagement of at least one engaging projection 58 of the scale plate 132' with the corresponding at least one engaging recess 34 of the housing 18, can be thus prevented as shown in FIGS. 47 and 48.

What is claimed is:

1. A timer device comprising:

timer circuit means;

time unit setting switch means which is movable to a selected one of plural positions to set a corresponding one of plural kinds of time units in the timer circuit means;

a housing for containing the timer circuit means and the time unit setting switch means;

a time setting knob connected to the timer circuit means to operate the timer circuit means and arranged to project from the housing;

at least two scale plates each having a through-hole through which the time setting knob is received, each scale plate having a time scale corresponding to a different one of the plural kinds of time units;

time scale attaching means for detachably mounting the scale plates individually onto the housing at a predetermined position; and scale-plate-guiding and time-unit-setting switch-position-holding means arranged at that area of each of said scale plates which area corresponds to the position of the time unit setting switch means when the scale plate confronts the housing at said predetermined position, wherein said guiding and holding means enables the scale plate attaching means to attach a selected scale plate to the housing at the predetermined position and prevents the time unit setting switch means from moving from an initial position which sets a particular time unit in the timer circuit means, when the time unit represented by the time scale on the selected scale plate coincides with the time unit set in the timer circuit means by the time unit setting switch means, and wherein said guiding and holding means prevents the selected scale plate from being attached to the housing at the predetermined position when the time unit represented by the time scale on the selected scale plate fails to coincide with the time unit set in the timer circuit means by the time unit setting switch means;

wherein the time unit setting switch means is of the slide type, and the scale-plate-guiding and time-unit-setting switch-position-holding means comprises a part of each of the scale plates, said part having a hole extending at least partially through a thickness of said scale plates into which hole a button of the time unit setting switch means is insertable when said button is located at a certain position to set in the timer circuit means a time unit corresponding to the time scale on the selected scale plate and when the scale plate is attached to the housing at the predetermined position and wherein the time unit setting switch means is prevented by said part from moving from said initial position.

2. A timer device according to claim 1, wherein the time scale attaching means includes engaging projections projected from the edge of each of the scale plates, an engagement releasing recess formed at the edge of each scale plate, engaging recesses formed in the housing and being engageable with the engaging projections of each scale plate when the selected scale plate is enabled to be attached to the housing at the predetermined position and an escaping recess formed in the housing to overlap the engagement releasing recess of the scale plate when the scale plate is attached to the housing at the predetermined position, to enable access to be attained from outside to the bottom surface of the scale plate through the engagement releasing recess.

* * * * *

UNITED STATES PATENT AND TRADEMARK OFFICE

CERTIFICATE OF CORRECTION

PATENT NO. : 4,551,588

DATED : November 5, 1985

INVENTOR(S) : Hiromi KUBOTA et al

It is certified that error appears in the above-identified patent and that said Letters Patent is hereby corrected as shown below:

Column 1, line 7, after "case of" delete "the";
line 39, change "circuit by means of" to --circuit means by way of--;
line 44, after "which is" insert --to be--;

Column 3, line 31, change "variously" to --various--;

Column 5, line 51, change "has a" to --includes--;

Column 11, line 64, change "plan or" to --planar--.

Signed and Sealed this

*Twenty-ninth* Day of *April 1986*

[SEAL]

*Attest:*

DONALD J. QUIGG

*Attesting Officer*

*Commissioner of Patents and Trademarks*